US008049168B2

(12) United States Patent
Sinclair

(10) Patent No.: US 8,049,168 B2
(45) Date of Patent: Nov. 1, 2011

(54) TIME-OF-FLIGHT SEGMENTED FARADAY

(75) Inventor: Frank Sinclair, Quincy, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 179 days.

(21) Appl. No.: 12/618,115

(22) Filed: Nov. 13, 2009

(65) Prior Publication Data

US 2010/0155593 A1 Jun. 24, 2010

Related U.S. Application Data

(60) Provisional application No. 61/138,787, filed on Dec. 18, 2008.

(51) Int. Cl.
*H01J 49/00* (2006.01)

(52) U.S. Cl. ..... 250/287; 250/492.1; 250/526; 250/315.3

(58) Field of Classification Search ..... None
See application file for complete search history.

(56) References Cited

U.S. PATENT DOCUMENTS

| | | | | |
|---|---|---|---|---|
| 5,164,596 | A * | 11/1992 | Noguchi et al. | 850/43 |
| 5,591,969 | A * | 1/1997 | Park et al. | 250/287 |
| 5,644,220 | A * | 7/1997 | Urs et al. | 324/71.3 |
| 6,137,112 | A * | 10/2000 | McIntyre et al. | 250/492.21 |
| 7,041,968 | B2 | 5/2006 | Enke | |
| 7,067,828 | B2 | 6/2006 | Swenson | |
| 7,078,679 | B2 * | 7/2006 | Westphall et al. | 250/287 |
| 7,282,709 | B2 * | 10/2007 | Darling et al. | 250/299 |
| 2002/0070361 | A1 * | 6/2002 | Mack et al. | 250/505.1 |
| 2006/0192134 | A1 * | 8/2006 | Renau et al. | 250/397 |
| 2007/0257199 | A1 * | 11/2007 | Gorrell et al. | 250/396 R |
| 2008/0073584 | A1 * | 3/2008 | Callahan et al. | 250/492.21 |
| 2008/0283778 | A1 * | 11/2008 | Tomimatsu et al. | 250/492.21 |
| 2009/0114813 | A1 * | 5/2009 | Koo et al. | 250/287 |

FOREIGN PATENT DOCUMENTS

| | | | |
|---|---|---|---|
| JP | 2006236601 A | * | 9/2006 |
| JP | 2007019375 A | * | 1/2007 |

OTHER PUBLICATIONS

V.I. Gushenets et al., "Simple and Inexpensive Time-of-Flight Charge-to-Mass Analyzer for Ion Beam Source Characterization," Rev. of Sci. Instrum. 77, 063301, 2006, pp. 1-3, Melville, NY, USA.

F.A. White et al., "Absolute Energy Measurement of Alpha Particles from Po210," Physical Review, vol. 109, No. 2, Jan. 15, 1958, pp. 437-442.

V. Kanarov et al., "High Resolution Energy Analyzer for Broad Ion Beam Characterization," Rev. of Sci. Instrum. 79, 093304, 2008, pp. 1-16, Melville, NY, USA.

I.A. Rusu et al., "Electron Plasma Parameters and Ion Energy Measurement at the Grounded Electrode in an RF Discharge," J. Phys. D.: Appl. Phys. 35, 2002, pp. 2808-2814, IOP Publishing Ltd., UK.

* cited by examiner

*Primary Examiner* — Phillip A Johnston
*Assistant Examiner* — Andrew Smyth

(57) ABSTRACT

This measurement device is used to determine energy for charged particles. The measurement device includes two segments and a plate that define two thresholds or gaps. The current as a charged particle passes through these thresholds or gaps is measured. The measurement device then calculates the energy of the charged particles. Energy contamination also may be determined.

10 Claims, 4 Drawing Sheets

TIME-OF-FLIGHT SEGMENTED FARADAY

CROSS-REFERENCE TO RELATED APPLICATIONS

This application claims priority to the provisional patent application entitled "Time-of-Flight Segmented Faraday," filed Dec. 18, 2008 and assigned U.S. App. No. 61/138,787, the disclosure of which is hereby incorporated by reference.

FIELD

This invention relates to a measurement device and, more particularly, to a Faraday cup that can determine the energy of a charged particle.

BACKGROUND

Ion implantation is a standard technique for introducing conductivity-altering impurities into semiconductor workpieces. A desired impurity material is ionized in an ion source, the ions are mass analyzed to eliminate undesired ion species, the ions are accelerated to form an ion beam of prescribed energy, and the ion beam is implanted into a workpiece. The energetic ions in the ion beam penetrate into the bulk of the workpiece material and are embedded into the crystalline lattice of the workpiece material to form a region of desired conductivity. Ion beam energy is an important parameter that is controlled during this ion implantation. Failure to control ion beam energy may result in the ions being implanted to an improper or undesired depth in the workpiece.

Measurement devices, such as Faraday cups, have been used in the past to measure beam current in ion implanters. Faraday cups are typically metal or graphite devices that catch charged particles, such as ions or electrons, in a vacuum. As the charged particles enter the Faraday cup, the resulting current is measured to determine the number of charged particles impacting the Faraday cup. Ion beam current, or the number of charged particles over a particular period of time, in an ion implanter may then be calculated using equation 1:

$$N/t=I/e \tag{1}$$

where N is the number of ions observed, t is the length of time in seconds, I is the measured current in amperes, and e is the elementary charge in coulombs. Elementary charge is the electric charge carried by a single proton or the negative of the electric charge carried by a single electron. This constant is approximately 1.6E-19 C.

FIG. 1 is a cross-sectional view of a first embodiment of a measurement device. The measurement device 101, which is a Faraday cup in this instance, has a plate 103 and a collection cup 102. The plate 103 defines an aperture 106 and is grounded in this embodiment. A threshold (represented by the dotted line 104) exists between the plate 103 and the collection cup 102. The measurement device 101 will output a signal to the current measurement device 105 when a is charged particle in the ion beam 100 crosses the threshold between the plate 103 and the collection cup 102 rather than, as might be assumed, when the charged particle strikes the back of the collection cup 102. FIG. 2 is a figure illustrating current over time for the first embodiment of the measurement device. At point 110, the charged particle in the ion beam 100 approaches the aperture 106 in the measurement device 101. An initial image charge appears and drives a current to the current measurement device 105. At point 111, the charged particle is at the threshold. At point 112 the charged particle passed through the aperture 106 and the threshold, creating most of the image charge. At point 113 the charged particle approaches the back of the collection cup 102. At point 114 the charged particle strikes the collection cup 102 and is neutralized by the image charge. No signal appears in the current measurement device 105 after point 113.

The measurement device 101 will integrate the electrical current that is measured by the current measurement device 105 to calculate the current of the ion beam 100. While prior art Faraday cups, such as measurement device 101, measure current, such a Faraday cup cannot calculate the energy of the charged particles, such as in the ion beam 100. This is an important parameter within the semiconductor manufacturing market as it determines the depth of penetration of the charged particle. Accordingly, there is a need in the art for an improved measurement device that can measure the energy of charged particles in a charged particle beam.

SUMMARY

According to a first aspect of the invention, a measurement device is provided. The measurement device comprises a plate defining an opening whereby an ion beam enters the measurement device. A first segment and the plate define a first threshold. A second segment and the first segment define a second threshold. A current measurement system is connected to the first segment and the second segment.

According to a second aspect of the invention, a measurement device is provided. The measurement device comprises a Faraday cup. The Faraday cup comprises a first segment, a second segment, and an entrance wall defining an aperture whereby an ion beam enters the Faraday cup. The entrance wall and the first segment define a first gap. The first segment and the second segment define a second gap. Both the first segment and the second segment completely surround the cross-section of the ion beam. A current measurement system is connected to the first segment and the second segment of the Faraday cup.

According to a third aspect of the invention, a measurement method is provided. The measurement method comprises directing a charged particle toward an opening of a measurement device. A current is measured as the charged particle passes across a first threshold between a plate of the measurement device and a first segment of the measurement device. A current is measured as the charged particle passes across a second threshold between a first segment of the measurement device and a second segment of the measurement device. The energy of the charged particle is determined.

BRIEF DESCRIPTION OF THE DRAWINGS

For a better understanding of the present disclosure, reference is made to the accompanying drawings, which are incorporated herein by reference and in which.

DETAILED DESCRIPTION

The measurement device is described herein in connection with an ion implanter. However, the measurement device can be used with other systems and processes involved in semiconductor manufacturing or other systems that use charged particles such as ions or electrons. Thus, the invention is not limited to the specific embodiments described below.

Figure 1:
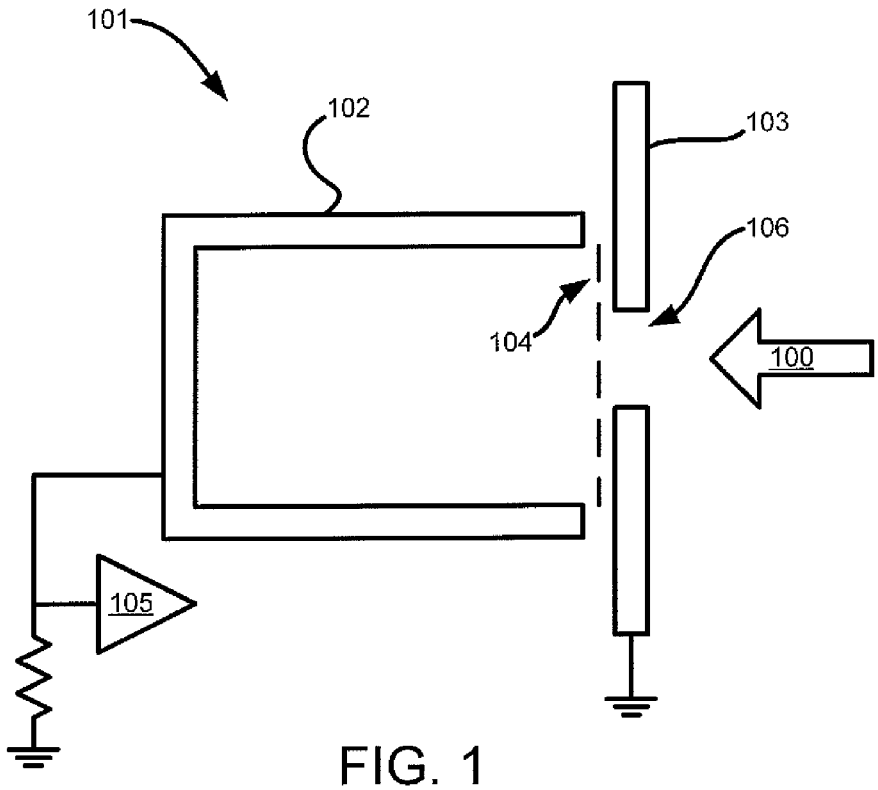
FIG. 1 (Prior Art)
FIG. 1 is a cross-sectional view of a first embodiment of a measurement device.
Figure 2:
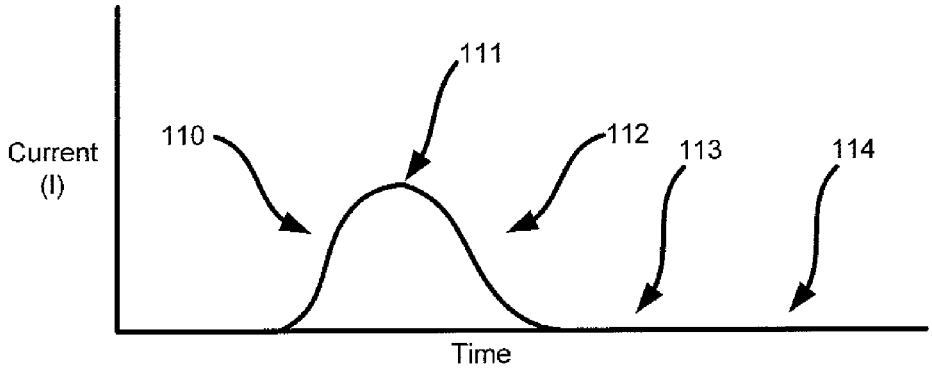
FIG. 2 (Prior Art)
FIG. 2 is a figure illustrating current over time for the first embodiment of the measurement device.
Figure 3:
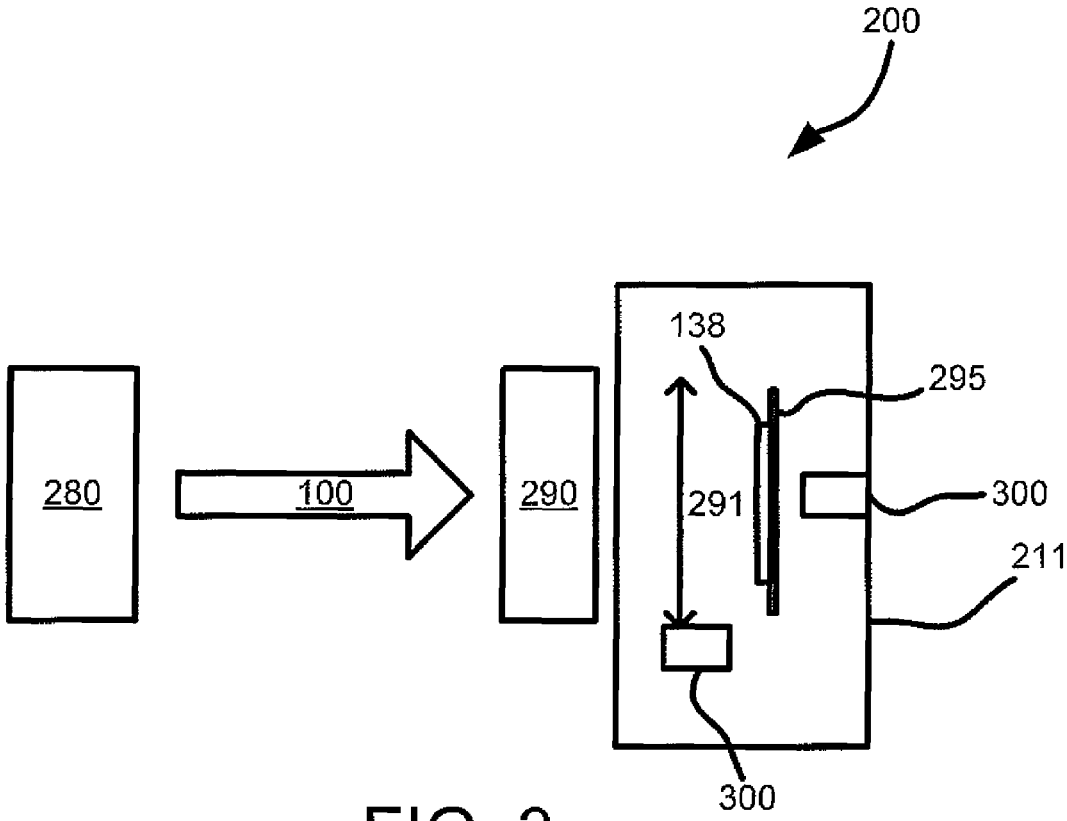
FIG. 3 (Prior Art)
FIG. 3 a block diagram of an embodiment of a beamline ion implanter.

Turning to FIG. 3, a block diagram of a beamline ion implanter 200 is illustrated. Those skilled in the art will recognize that the beamline ion implanter 200 is only one of many examples of beamline ion implanters that can provide ions. In general, the beamline ion implanter 200 includes an ion source 280 to generate ions that are extracted to form an ion beam 100, which may be, for example, a ribbon beam or a spot beam. The ion beam 100 may be mass analyzed and converted from a diverging ion beam to a ribbon ion beam with substantially parallel ion trajectories. The beamline ion implanter 200 may further include acceleration or deceleration unit 290 in some embodiments.

An end station 211 supports one or more workpieces, such as workpiece 138, in the path of the ion beam 100 such that ions of the desired species are implanted into workpiece 138. In one instance, the workpiece 138 may be a 300 mm diameter silicon wafer. However, the workpiece 138 is not limited to a silicon wafer. The workpiece 138 could also be, for example, a flat panel, solar, or polymer substrate. The end station 211 may include a platen 295 to support the workpiece 138. The end station 211 also may include a scanner (not shown) for moving the workpiece 138 perpendicular to the ion beam 100 cross-section, thereby distributing ions over the entire surface of workpiece 138.

The ion implanter 200 includes at least one measurement device 300 in this particular embodiment. The measurement device 300, which may be a Faraday cup, is located in the end station 211. This measurement device 300 may be translated or scanned across the path of the ion beam 100 in one instance (as illustrated by the line 291). In another embodiment, the measurement device 300 may be located behind the platen 295 and may measure when the platen 295 is translated or scanned away from the measurement device 300. Of course, the measurement device 300 may be located elsewhere within the ion implanter 200 and is not limited solely to being located within the end station 211.

The ion implanter 200 may include additional components known to those skilled in the art such as automated workpiece handling equipment or an electron flood gun. It will be understood to those skilled in the art that the entire path traversed by the ion beam 100 is evacuated during ion implantation. The beamline ion implanter 200 may incorporate hot or cold implantation of ions in some embodiments.

Figure 4:
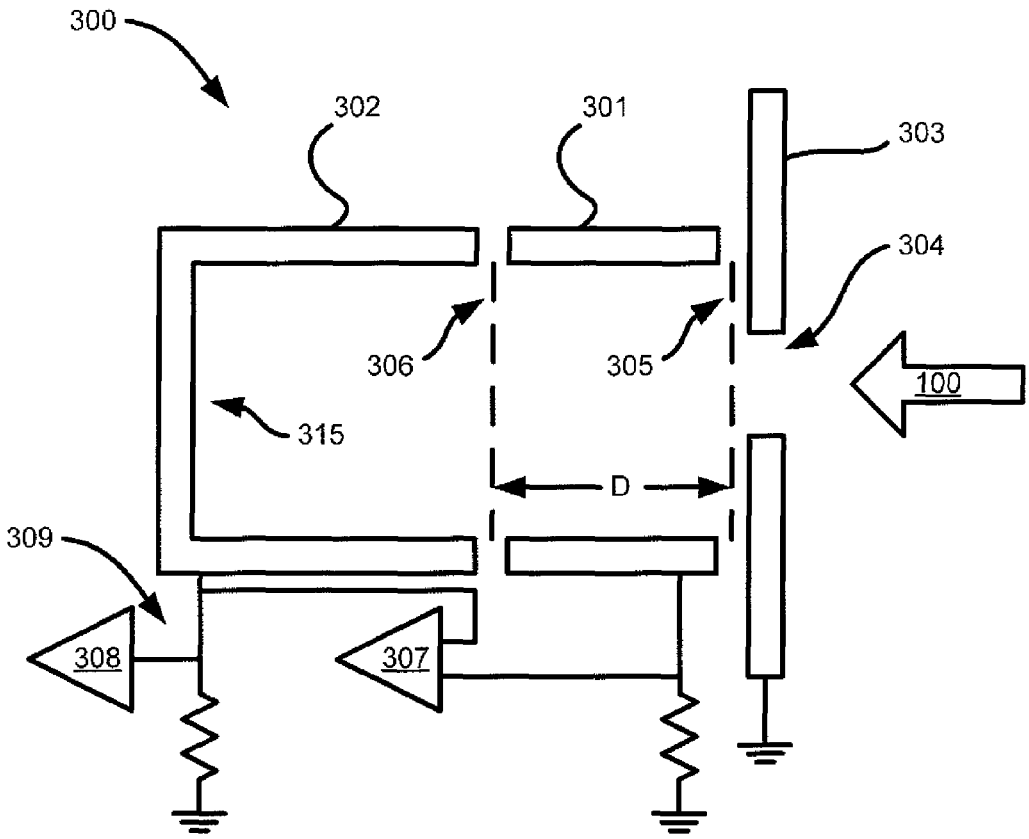
FIG. 4 is a cross-sectional view of a second embodiment of a measurement device.

FIG. 4 is a cross-sectional view of a second embodiment of a measurement device. The measurement device 300, which is a Faraday cup in this instance, has a plate 303, a first segment 301, and a second segment 302. The second segment 302 has a rear wall 315 and is cup-shaped in this particular embodiment, although other shapes and configurations are possible. The first segment 301 is tube-shaped in this particular embodiment, though other shapes or configurations are possible. The first segment 301 and second segment 302 may completely encircle or surround the charged particles of the ion beam 100 that enter the measurement device 300. The plate 303, which may be a wall of the measurement device 300, is grounded in this embodiment and defines an aperture 304. A first threshold or gap (represented by the dotted line 305) exists between the plate 303 and the first segment 301. A second threshold or gap (represented by the dotted line 306) exists between the first segment 301 and the second segment 302. The first segment 301 and second segment 302 and the first segment 301 and the plate 303 may not be in direct contact in this particular embodiment.

The measurement device 300 includes a current measurement system 309. In one particular embodiment, the measurement device 300 will output a signal to the current measurement device 307 when a charged particle in the ion beam 100 crosses the first threshold between the plate 303 and the first segment 301. The measurement device 300 will then output a signal to the current measurement device 307 and the current measurement device 308 when a charged particle in the ion beam 100 crosses the second threshold between the first segment 301 and the second segment 302. The current measurement device 307 will determine total current ($I_t$) for the measurement device 300. The current measurement device 308 will determine secondary current ($\bar{I}_t$) for the measurement device 300. The two measurements are separated by a distance D.

By combining the time-of-flight and the mass of the charged particle in the ion beam 100, kinetic energy (E) for the charged particle in joules may be calculated using equation 2:

$$E=m(D/\tau)^2/2 \tag{2}$$

where D is the distance between the two thresholds in m, m is the mass of the charged particle in kg, and $\tau$ is the time the charged particle takes to go the to distance D between the two thresholds in s. In a typical ion implanter, m is known. In one embodiment, D is approximately 5 cm. This calculation is independent of the charge state of the charged particle. Thus, the charge of the particle has little or no effect on the calculation because m is approximately the same as the charge varies. E may be averaged for the ion beam 100 in one embodiment. To convert the measured energy from Joules to the more usual unit of electron volts (eV), the numerical value should be divided by the elementary charge (e) in Coulombs.

$\tau$ may be short for high energy ions. For example, a 500 keV phosphorus ion may cross a distance of 5 cm in approximately 28 ns. Modern electronics are capable of resolving $\tau$ accurately, even with such a short time period. The digital signal processing system used to calculate E may be configured to resolve $\tau$ for high energy ions.

Figure 5:
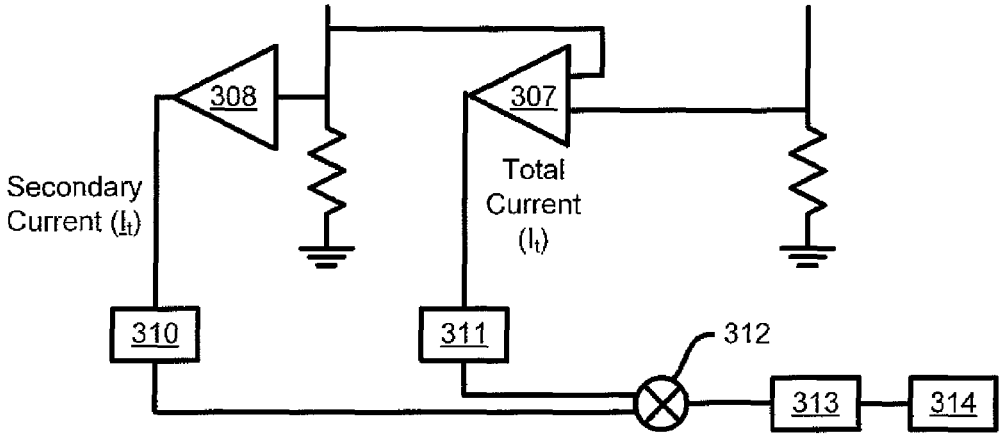
FIG. 5 is a diagram of an embodiment of a digital signal processor.
Figure 6:
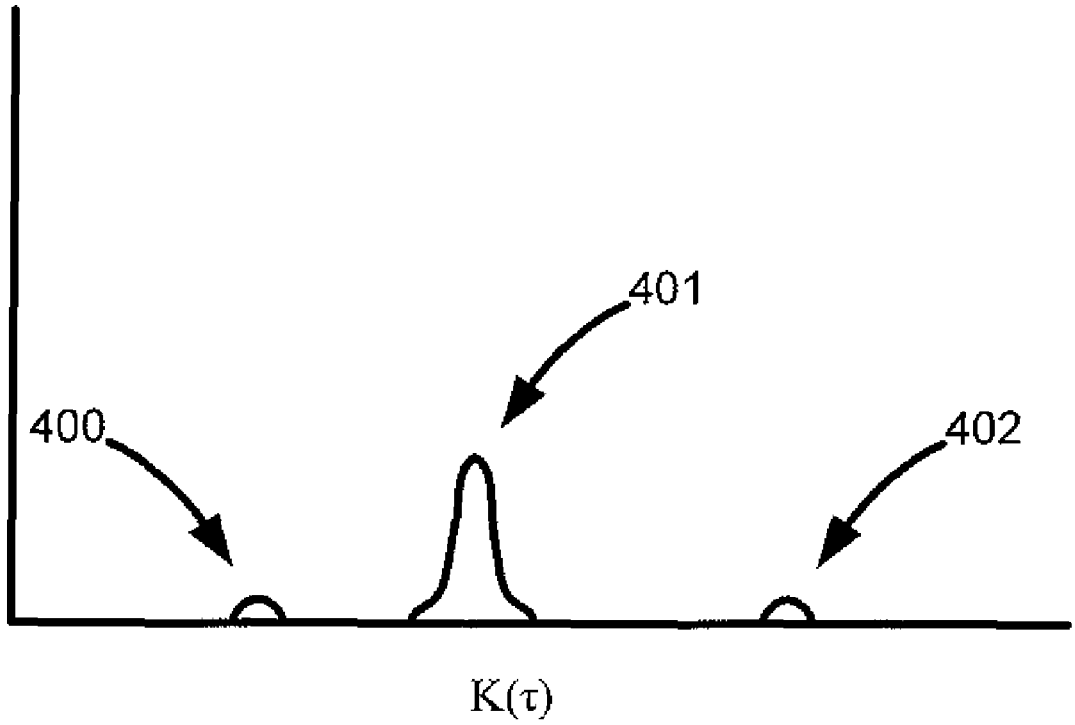
FIG. 6 is a figure illustrating the convolution function of the digital signal processor of FIG. 5.

FIG. 5 is a diagram of an embodiment of a digital signal processor. The current measurement device 307 determines total current ($I_t$) and the current measurement device 308 determines secondary current ($\bar{I}_t$) for the measurement device 300. The $I_t$ and $\bar{I}_t$ analog inputs are digitalized and processed using a fourier transform or fast fourier transform (FFT) with operations 310 and 311. The outputs are multiplied using operation 312 and an inverse fourier transform or inverse FFT is taken using operation 313. This will calculate the correlation between the $I_t$ and $\bar{I}_t$ signals. An accumulator 314 may integrate the convolution function ($K(\tau)$) for a time period, such as approximately one second. The use of this accumulator 314 may separate the useful signal from any anticipated noise, as illustrated in FIG. 6. $K(\tau)$ will result in peaks 400 and 402 for high and low energy contaminants and also the main peak 401. Use of the measurement device 300, with both thresholds or gaps, to measure the charged particles will produce a step function where the height of the peaks is directly equal to the integrated charge that has crossed the threshold or gap.

The charged particle beam intensity may be modulated in one embodiment to allow for the measurement device 300 to register the charged particles. If the charged particle beam current lacks any high frequency variations, fluctuations may be introduced by, for example, applying a short voltage pulse either to the plasma producing mechanism (e.g., the arc voltage in the ion source 280) or to one of the transport elements (e.g., a suppression electrode in a deceleration unit 290). Such modulation would only affect the current of the charged particle beam for a few nanoseconds, but would provide a perturbation or "marker" whose time of arrival at the measurement device 300 would allow the velocity of the charge particles in the beam to be calculated. The length of the beamline in the ion implanter divided by the transit time between the "marker" source and the measurement device 300 will be the velocity of the charged particles. To compare this actual velocity to a desired velocity, the length of the beamline in the ion implanter (or the distance the charged particles in the ion beam travel) is divided by the desired ion velocity to provide the desired transit time for a "marker" in the ion current to propagate. In one particular embodiment, a DC ion beam is used and the noise of the beam signature may provide a marker. In another particular embodiment, an RF accelerated beamline is used, which produces an ion beam that is "bunched" in time or separated into discrete pulses. An RF accelerated beamline with a "bunched" ion beam may be used to measure energy.

Embodiments of this measurement device 300 respond to charged particles in the ion beam 100 and, thus, will not respond to neutral particles. Energy contamination, or the charge exchange with gases or within the ion beam 100 to form neutral particles, may occur. In situations where energy contamination occurs, collisions between the formed neutral particles and a background gas will ionize or re-ionize some of these neutral particles. Any ionized or re-ionized neutral particles will be measured by the measurement device 300. The fraction of ionized or re-ionized neutral particles actually detected may be calculated in one instance with calibration. In one particular embodiment, a background gas is injected into the measurement device 300 to increase ionization or re-ionization. An electron or photon beam also may be used with the measurement device 300 to increase ionization or re-ionization.

Energy contamination, or charged particles with undesired energies, in the measurement device 300 may be calculated. Energy contamination will form high energy contaminants 400 and low energy contaminants 402. These, in one instance, represent charged particles that are travelling at a different speed through the beamline than the desired charged particles. For example, some high energy contaminants may be neutral particles that were ionized or re-ionized after passing through a deceleration unit 290. Such neutral particles were not affected by the deceleration unit 290 and, therefore, travel faster than the desired charged particles in the ion beam. Likewise, some low energy contaminants may be neutral particles that were ionized or re-ionized after passing through an acceleration unit 290. These neutral particles were not affected by the acceleration unit 290 and, therefore, travel slower than the desired charged particles in the ion beam. In one instance, the acceleration unit and deceleration unit may be separate units in the same beamline ion implanter.

As seen in FIG. 6, high energy contaminants 400 will take a shorter time to travel between the two thresholds in the measurement device 300 than charged particles in the main peak 401. Low energy contaminants 402 will take a longer time than charged particles in the main peak 401 to travel between the two thresholds in the measurement device 300. The time spectrum of the convolution function or some other correlation function will show these high energy contaminants 400 and low energy contaminants 402. Any energy contamination that occurs between the first threshold and second threshold in the measurement device 300 may be calculated, but this calculation depends on the pressure within the measurement device 300.

Neutralization in the measurement device 300 between two charged particles that form two neutral particles will not affect the measurement device 300. Any such neutralization will require an electron to be transferred within the measurement device 300, so the net charge within the measurement device will remain the same. The image charge remains the same even if a charged particle is neutralized when it picks up an electron because this will create a positive charge in another particle. Furthermore, the pressure within the measurement device 300 may be low enough that this form of neutralization is negligible.

In a high current ion implanter where a deceleration unit 290 is used, the measurement device 300 may be used as an implant energy monitor to validate the amount of energy contamination. Such a measurement device 300 may be sensitive to an approximately 0.1% signal. Most of the energy contamination in a high energy ion beam 100 is neutral atoms proximate to a workpiece 138. Some neutral particles will be re-ionized with a background gas, but this fraction will scale with the ionization cross-section. Such a cross-section goes down quickly for low energies. In one particular embodiment, re-ionization may be performed using an electron beam or a photon beam.

In medium current or high energy ion implanters, ions with a double or triple charge may be used to extend the implanter's range capabilities. Due to these charges, multiple charge exchange and stripping mechanisms may lead to energy contamination. Locating the measurement device 300 in the plane where the workpiece 138 is positioned allows monitoring these charge exchanges and stripping mechanisms.

In one embodiment, the measurement device 300 is connected to a controller for an ion implanter, such as the beamline ion implanter 200. If the ion energy for the ion beam 100 is incorrect or the amount of energy contamination in the ion beam 100 exceeds a predetermined level, the controller may shut down the ion beam 100 or block the ion beam 100 from impacting the workpiece 138, thereby preventing implantation of the workpiece 138. The controller may tune the beamline ion implanter 200 or adjust parameters of components of the beamline ion implanter 200 to correct the beam energy or the amount of energy contamination in another embodiment.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A measurement device comprising:

a plate defining an opening whereby charged particles enter said measurement device;

a first segment, said first segment and said plate defining a first threshold;

a second segment, said second segment and said first segment defining a second threshold, said second segment having a rear wall; and a current measurement system connected to said first segment and said second segment, wherein said current measurement system comprises a total current measurement device connected to said first segment and said second segment and a secondary current measurement device connected to said second segment, said secondary current measuring device providing a secondary current signal and said total current measurement device providing a total current signal.

2. The measurement device of claim 1, wherein said plate, said first segment, and said second segment comprise a Faraday cup.

3. The measurement device of claim 1, wherein said plate is a wall of said measurement device.

4. The measurement device of claim 1 wherein said measurement device further comprises a digital signal processor.

5. The measurement device of claim 4, wherein said digital signal processor is configured to determine a kinetic energy of said charged particles using said secondary current signal and said total current signal.

6. The measurement device of claim 1, wherein said current measurement system is configured to determine energy contamination of said charged particles.

7. A measurement device comprising:

a Faraday cup comprising a first segment, a second segment, and an entrance wall defining an aperture whereby charged particles enter said Faraday cup, said entrance wall and said first segment defining a first gap, said first segment and said second segment defining a second gap, both said first segment and said second segment completely surrounding said charged particles; and a current measurement system connected to said first segment and said second segment of said Faraday cup, wherein said current measurement system comprises a total current measurement device connected to said first segment and said second segment and a secondary current measurement device connected to said second segment, said secondary current measuring device providing a secondary current signal and said total current measurement device providing a total current signal.

8. The measurement device of claim 7, wherein said measurement device further comprises a digital signal processor.

9. The measurement device of claim 8, wherein said digital signal-processor is configured to use said secondary current signal and said total current signal to determine a kinetic energy of said charged particles.

10. The measurement device of claim 7, wherein said current measurement system is configured to determine energy contamination of said charged particles.

* * * * *